US007925480B2

(12) United States Patent
Berger et al.

(10) Patent No.: US 7,925,480 B2
(45) Date of Patent: Apr. 12, 2011

(54) TOOL FOR IDENTIFYING PROJECT ENERGY INTERDEPENDENCIES

(75) Inventors: W. Andrew Berger, Clarks Summit, PA (US); Robert A. Spalletta, Scranton, PA (US); Jerry A. Carter, Clarks Green, PA (US)

(73) Assignee: The University of Scranton, Scranton, PA (US)

( * ) Notice: Subject to any disclaimer, the term of this patent is extended or adjusted under 35 U.S.C. 154(b) by 817 days.

(21) Appl. No.: 11/886,376

(22) PCT Filed: Mar. 30, 2006

(86) PCT No.: PCT/US2006/011546

§ 371 (c)(1),
(2), (4) Date: Sep. 15, 2007

(87) PCT Pub. No.: WO2006/105243

PCT Pub. Date: Oct. 5, 2006

(65) Prior Publication Data

US 2009/0043553 A1 Feb. 12, 2009

Related U.S. Application Data

(60) Provisional application No. 60/666,970, filed on Mar. 31, 2005.

(51) Int. Cl.
*G06G 7/48* (2006.01)
*G06G 7/50* (2006.01)

(52) U.S. Cl. ..... 703/9; 703/2

(58) Field of Classification Search ..... 703/9
See application file for complete search history.

(56) References Cited

U.S. PATENT DOCUMENTS 4,389,071 A * 6/1983 Johnson et al. ..... 299/14
5,927,329 A * 7/1999 Yie ..... 137/624.13
6,768,973 B1 * 7/2004 Patel ..... 703/2
6,854,529 B2 * 2/2005 Kuntze et al. ..... 173/1

OTHER PUBLICATIONS

Hahs, Charles, "Design Parameters for Water Jet Tunneling Machines", SPE 72-0555, 14th U.S. Symposium on Rock Mechanics, Jun. 11-14, 1972.*

Mohan et al, "Energy Dissipation Control in Hydro-Abrasive Machining Using Quantitative Acoustic Emission", Int. J. Adv. Manuf. Technol. 2002, 20:397-406.*

(Continued)

*Primary Examiner* — Mary C Jacob
(74) *Attorney, Agent, or Firm* — Charles L. Riddle, Esq; Riddle Patent Law, LLC

(57) ABSTRACT

A simulation system [200] models and optimizes parameters for a pulsed liquid slug boring system employing an energetic fluid [7]. The simulation system [200] employs a fluid flow energy unit [251], an exhaust and retention energy unit [253] and a comminuting energy unit [255] to calculate energies of the system. Total energy unit [257] combines these energies. Fluid flow energy unit 251 receives fluid volume and calculates the fluid flow energy. Exhaust and retention energy unit 253 receives input from the exhaust energy volume unit [243] and mission duration unit [211] to determine the exhaust and retention energy. Comminuting energy unit 255 receives hole depth and hole diameter and specific energy of rock to determine the require comminuting energy. The simulation system [200] operates to determine optimum values of design parameters by searching for the minimum energy solution.

16 Claims, 6 Drawing Sheets

OTHER PUBLICATIONS

Lebar et al, "Simulation of Abrasive Waterjet Machining Based on Unit Event Features", Proceedings of the Institution of Mechanical Engineers, Part B: Journal of Engineering Manufacture, vol. 217, No. 5, 2003, pp. 699-703.*

Sheshtawy et al, "A Laboratory Study of High Pressure Fluid Jet Drilling", SPE 4520, 1973.*

Pederick et al, "Increased Flexibility Using Waterjet Assisted Blasthole Drilling", Proceedings of Explo Jul. 2004, Perth, WA.*

* cited by examiner

TOOL FOR IDENTIFYING PROJECT ENERGY INTERDEPENDENCIES

This application is the National Stage of International Application No. PCT/US2006/011546, filed Mar. 30, 2006, which claims priority to Provisional Application No. 60/666,970 filed Mar. 31, 2005, and incorporates the same by reference as if set forth herein in its entirety.

BACKGROUND OF THE INVENTION

1. Field of the Invention

The present invention relates to a tool for modeling and optimizing design parameters for a pulsed boring system.

2. Discussion of Related Art

There currently are systems for modeling and aiding in design of various systems. The models are very specific and developed to mimic a certain system. Since they only model the system for which they were developed, a new model must be developed for each new system.

There appear to be no models developed for a pulsejet boring system employing underground combustion of energetic fluids. Therefore, any prior art models would not apply to the current system to be modeled, and would require manual selection of parameter values to find an optimum set.

This becomes very time-consuming and tedious with no guarantee that an optimum parameter set will be determined.

Models also used to determine if a given set of parameters values will result in a functional unit.

Since there are no models developed for the above-mentioned system, functionality may be determined by creating prototypes of various design parameters and testing them.

This can become very expensive with no guarantee that the systems will function.

Currently, there is a need for a modeling system for determining optimized design parameters for a pulsejet boring system employing combustion of energetic fluids.

SUMMARY OF THE INVENTION

One embodiment of the present invention is a system [200] for modeling the energy of an energetic fluid pulsejet boring system comprising:

a. a fluid flow energy unit [251] for receiving an indication of fluid volume and mission duration and for calculating fluid flow energy from its inputs;

b. an exhaust and retention energy ("EARE") unit [253] for receiving an indication of exhaust gas volume and mission duration as inputs and for calculating exhaust and retention energy from its inputs, c. a comminuting energy unit [255] for receiving an indication of hole diameter and specific energy of rock intended to be bored as inputs, and calculating comminuting energy form its inputs, d. a total energy unit [257] for receiving the fluid flow energy from the fluid flow energy unit [251], the exhaust and retention energy from the EARE unit [253], and the comminuting energy from the comminuting energy unit [255], to calculate an estimate of total energy of said energetic boring system.

Another embodiment of the present invention is a method of optimizing parameters of an energetic pulsejet boring system constrained by project requirements and a maximum total energy restriction, comprising the steps of:

a) receiving defined system inputs [503];

b) receiving a maximum allowable energy, "$E_{max}$" [505];

c) receiving said project requirements defining acceptable ranges of a plurality of system parameters [507];

d) determining an integrated set of parametric equations modeling the total energy of the system in terms of said system parameters;

e) calculating a solution set of entries each having system parameter values for each total energy value of the system, over a plurality of system parameter values, using the defined system inputs;

f) locating minimum energy points ("MEP") [513] in the solution set;

g) if the values of parameters at an MEP are not within the acceptable ranges [515], then selecting the parameters values to move away [517] from the MEPs until parameters are encountered which meet said project requirements;

h) if no entries are encountered before the energy of the system reaches $E_{max}$ [523], then indicating that there is no acceptable design solution based upon the given inputs [525].

Still another embodiment of the present invention is a method of determining the system parameters values of a pulsejet boring system having a defined mission duration, hole depth, hole diameter, rock density, fluid energy density, fluid density, for a particular drilling methodology creating a specific particle size, comprising:

a. receiving an acceptable ranges [507] of hole size, penetration rates, and total energy of the system;

b. creating an integrated set of parametric equations [509] in which:

i. comminuting energy is a function of hole depth, hole diameter and specific energy of rock;

ii. exhaust & retention energy is a function of exhaust gas volume and mission duration;

iii. fluid flow energy is a function of fluid volume and mission duration, iv. total energy as the sum of comminuting energy, exhaust and retention energy, and fluid flow energy;

c. calculating total energy entries [513] for various hole sizes and penetration rates as a solution set;

d. determining [515] if the solution set has entries with a hole size, penetration rate and total energy within the acceptable ranges received in step "a" above; and e. using parameter values of the solution set entries within the acceptable ranges as the system parameter values for optimizing the system.

OBJECTS OF THE INVENTION

It is an object of the present invention to provide a system for determining if a pulsejet boring system is feasible using a given design parameter values.

It is an object of the present invention to provide a system for automatically determining design parameters for a pulsejet boring system.

It is another object of the present invention to provide a system for automatically optimizing selected design parameters of a pulsejet boring system.

BRIEF DESCRIPTION OF THE DRAWINGS

The advantages of the instant disclosure will become more apparent when read with the specification and the drawings, wherein.

DETAILED DESCRIPTION OF THE INVENTION

When modeling a system, the fundamental interrelationships between component parts are studied, as well as the consequences of each design choice on all other parts of the system.

Figure 1:
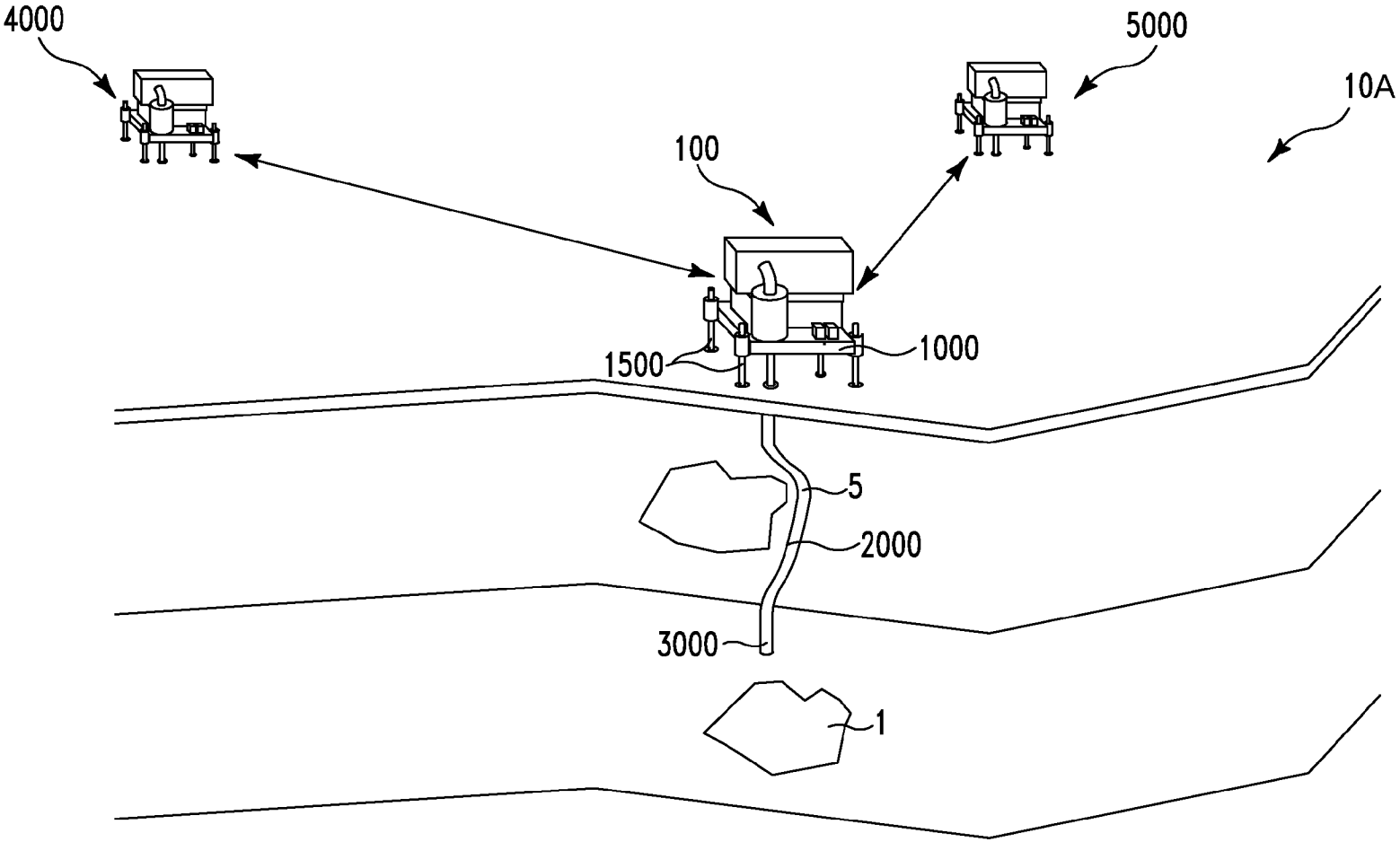
FIG. 1 is a perspective view of a system to be modeled having a ground unit employing a pulsejet boring head.

FIG. 1 is a perspective view of a system to be modeled having a ground unit employing a pulsejet boring head.

Ground unit 100 is placed on the ground just above a target 1 which may be an underground void or object. Ground unit 100 may be delivered there by a number of different conventional known methods.

Ground unit 100 employs a platform subsystem 1000 having retention and orientation devices 1500 which secure ground unit 100 to the ground and tilts platform 1000 to an optimum orientation for boring to target 1. Platform subsystem 1000 is designed to hold, store and carry all the equipment during deployment, initiate boring of an access hole, hold materials to be used in a fuel reservoir, stabilize ground unit 100 for boring, and communicate with other units.

A boring subsystem 3000 employs at least one pulsejet which bores down through the ground toward target 1, creating an access hole 5. Boring subsystem 3000 is designed to create pulse explosions forcing liquid slugs to impact material s (rock) to be bored. The exhaust gases force the excavated materials out of the access hole 5 and to the surface.

Boring subsystem 3000 is connected to platform subsystem 1000 by an umbilical subsystem 2000.

Umbilical subsystem 2000 also employs mechanical actuators and exhaust gas retro-jets to provide retention forces produced during boring, as well as for steering and advancing umbilical subsystem 2000 and boring 3000 subsystems deeper into the access hole 5.

Figure 2:
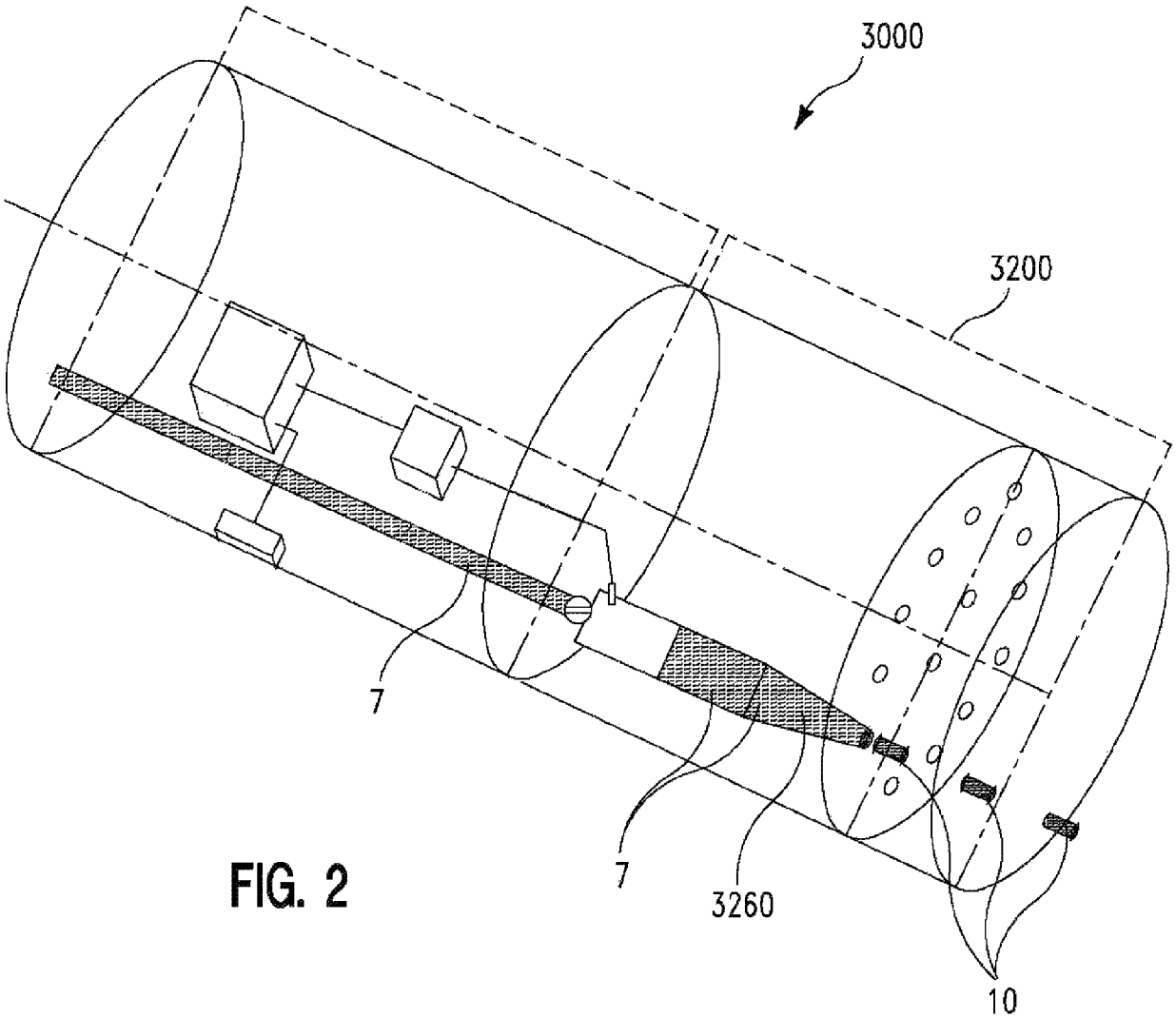
FIG. 2 is an enlarged perspective view of the pulsejet boring head of the system of FIG. 1.

FIG. 2 is a perspective view of one embodiment of a boring subsystem 3000 according to the present invention. The end of the boring subsystem 3000 is a boring head 3200 containing ten to twenty pulsejets 3100. Pulsejets 3100 receive energetic fluid 7, and cause the fluid to create a rapidly expanding bubble forcing portions of the fluid out of a nozzle 3260 at high speeds as a plurality of fluid slugs 10. Since the fluid used is highly incompressible, the impact of slugs 10 bores through rock and earth.

Energetics

Energy simulations require the reduction of each logical component of the boring system 10A to an energy transaction. A critical component of this type of design is to identify the interdependencies of the system.

A pulsejet design utilizes chemical energy stored on platform 1000 and an energetic fluid delivery system, umbilical 2000 and boring head 3200.

The energy balance simulation investigates the energy required to accomplish the task, and should include all sources of energy and all energy requirements. The total energy stored on platform (1000 of FIG. 1) must equal or exceed the energy required.

The system energies are co-dependent. For example, a design change that increased the energy density of the fluid would be shown to require a concurrent increase in the fluid density of the exhaust and the cross-sectional area devoted to exhaust.

For example, the area of the umbilical is the sum of the areas devoted to the delivery of supplies (fluids, electrical, etc.) to the borehead, the internal exhaust of rock and drilling fluids, control and communications, steering and retention. But these areas themselves are not independent. Consider the area devoted to internal exhaust. Decreasing that area requires an increase in the area devoted to retention (since the pressure developed at the borehead will increase as will the frictional forces inside the tube). Ultimately, all of the parameters and their interrelationships can be expressed mathematically, and boundary conditions established which will lead to a solution contained within the solution space.

A precise study of the energy conversion (or thermodynamics) of a pulsejet system will establish boundary conditions on key physical parameters, such as the mass density and energy density of the fluid.

The specific energy for rock removal is a function of fluid slug energy, the mass ratio of fluid to rock is a function of fluid slug energy and the exhaust and retention energies are functions of rock particle size (which itself is based on the specific energy of rock removal, and ultimately fluid slug energy).

System components that are independent of all other components are top level, components dependent on only one other logical component are the next level, and components dependent on several other components are the lowest level.

This invention is a method and software system for modeling the interdependencies of physical parameters to identify a workable set of physical parameters. The parameters of the system include: exhaust gas volume, rock density, cutting fluid energy density, physical density of fluid, mission duration, fluid volume, fluid flow energy, hole depth, hole diameter, drilling methodology, rock particle size, and the specific energy of rock. Most of the values of these parameters are provided, whereas others are calculated by the system.

Figure 3:
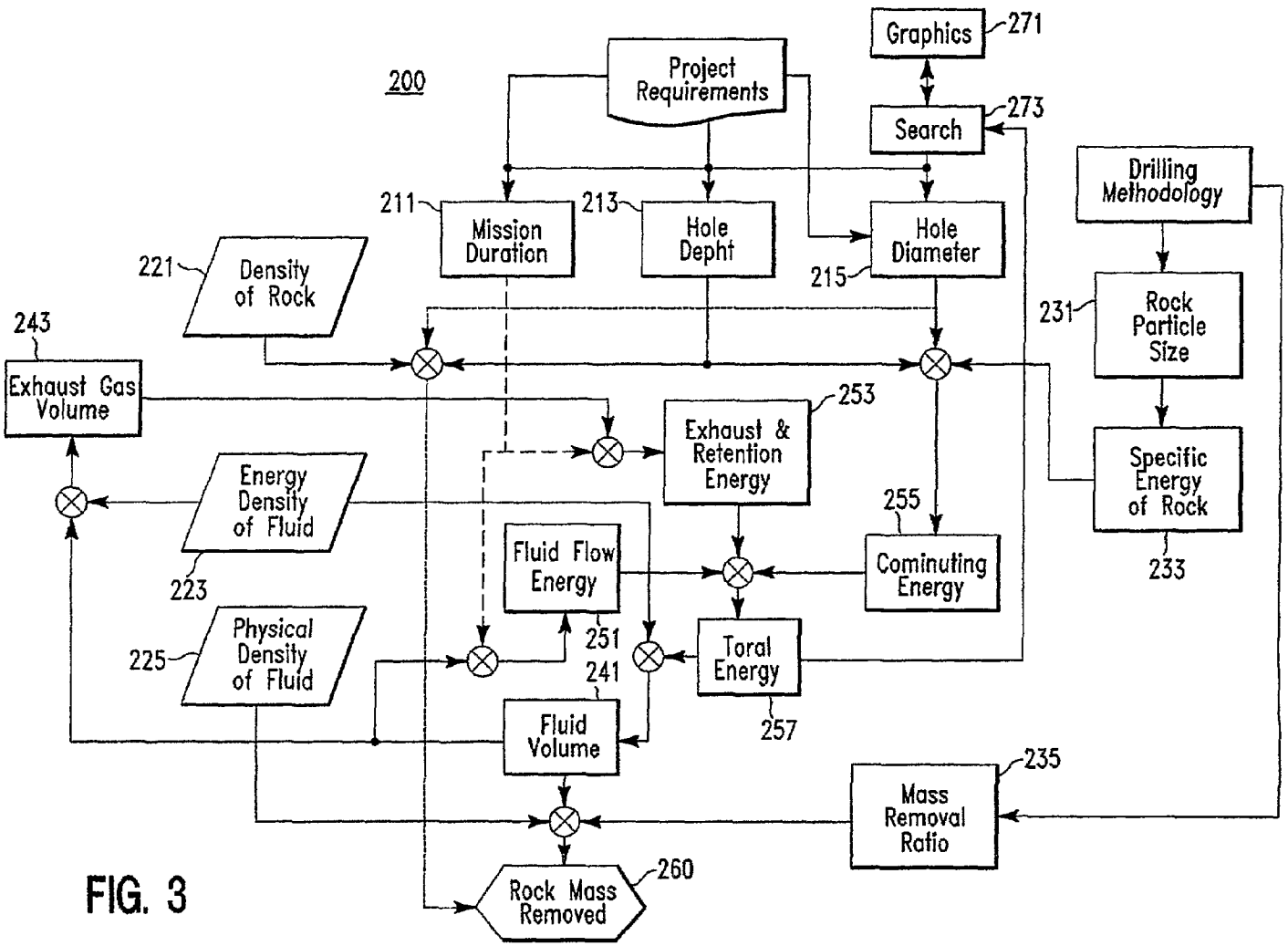
FIG. 3 is a schematic block diagram of one embodiment of an energy simulation system according to the present invention for modeling and optimizing the system shown in FIG. 1.

FIG. 3 is a simplified schematic block diagram of a simulation system according to the present invention. This is set up to model the functioning the pulsejet boring system shown in FIGS. 1-2. This can be modeled mathematically, or reduced to software which solves the mathematical model. Separate subroutines may be modeled on separate computing devices that are interconnected.

Therefore, the simulation system shown in FIG. 3 may be either a mathematical model, a model implemented on a computer program or a set of interconnected computing units which run software routines to perform these functions.

The simulation system 200 seeks to map out the interdependencies of the flow and conversion of energy. The physical properties of the fluid are mapped in block 221, 223, 225. The system inputs are indicated by blocks 211, 213, 215. System parameters which are dependent on only one other parameter are in blocks 231, 233, 235.

Project requirements such as initial values of mission duration, hole depth and hole diameter are received and stored by units 211, 213, 215, respectively.

The density of rock (the material which will be bored) is stored in unit 221.

The energy density of fluid to be used is stored in unit 223. The physical density of fluid used is stored in unit 225.

A drilling methodology is chosen. This is determined by the method of drilling. They type of boring may be pulsed fluid, continuous liquid jet, mechanical, etc. The boring chosen was pulsed liquid boring. This type of boring has numerous options to be chosen regarding the width of liquid slugs, the angle of the leading portion of the slug, the number of liquid slug sources, their relative angles, the pulse rate, intensity, etc. The drilling methodology determines the rock particle size which is stored in unit 231.

The rock particle size determines the specific energy of the rock, which is stored in unit 233.

The comminuting energy unit 255 determines the comminuting energy from the hole diameter received from unit 215, the specific energy of the rock received from unit 233 and the hole depth received from unit 213.

The energies of the rock particles, the exhaust gasses being expelled from hole 5 to the surface, and the retention energy to hold umbilical 2000 and boring head 3200 inside borehole 5 are determined by Exhaust & Retention Energy unit 253. It receives an estimate of the exhaust gas volume and the stored mission duration stored in unit 221.

A fluid flow energy unit 251 calculates the energy of passing the fluid through the system. It receives an indication of fluid volume from a fluid volume unit 241.

Fluid volume unit 241 receives an indication of total energy of the systems and the energy density of the fluid being used, and calculates a total fluid volume and provides it to fluid flow energy unit 251 and to exhaust gas volume unit 243.

Exhaust gas volume unit 243 calculates the total exhaust gas volume and provides the calculation to the exhaust & retention unit 253 as input.

Total energy unit 257 calculates the total energy of the system by summing the energies from calculated by the fluid flow energy unit 251, the exhaust & retention unit 253 and the comminuting unit 255.

The output of the total energy unit 257 is provided as input to fluid volume unit 241.

Rock mass unit 260 calculates rock mass removed form the physical density stored in unit 225, the system fluid volume from fluid volume unit 241 and the mass removal ratio stored in mass removal unit 235. The mass removed ratio is determined by the drilling methodology selected.

In one embodiment of the present invention, most parameters will be defined and the solution set for the undefined parameter(s) will be provided.

In this embodiment, a search unit 273 interactively varies at least one input parameter, and determines the total energy from total energy unit 257. Search unit 273 then receives and stores the solutions to produce a solution set.

In one embodiment, a graphic unit 271 displays the solution set to a user who visually determines a minimum energy point and then selects values of the parameters near the energy point which satisfy other requirements, such as a maximum system energy allowed. For example, one may select hole diameter and mission duration (boring penetration rate) as inputs to vary. The total system energy for various values of the hole diameter and the mission duration is then graphed to produce a surface. The user selects a low point on the surface, and if below a maximum energy, defines hole diameter and mission duration which is optimized relating to total energy.

In another embodiment of the present invention, a set of parameters values to be tested are input to the system. The system then identifies if the parameters are one of the solutions (is feasible).

Figure 4:
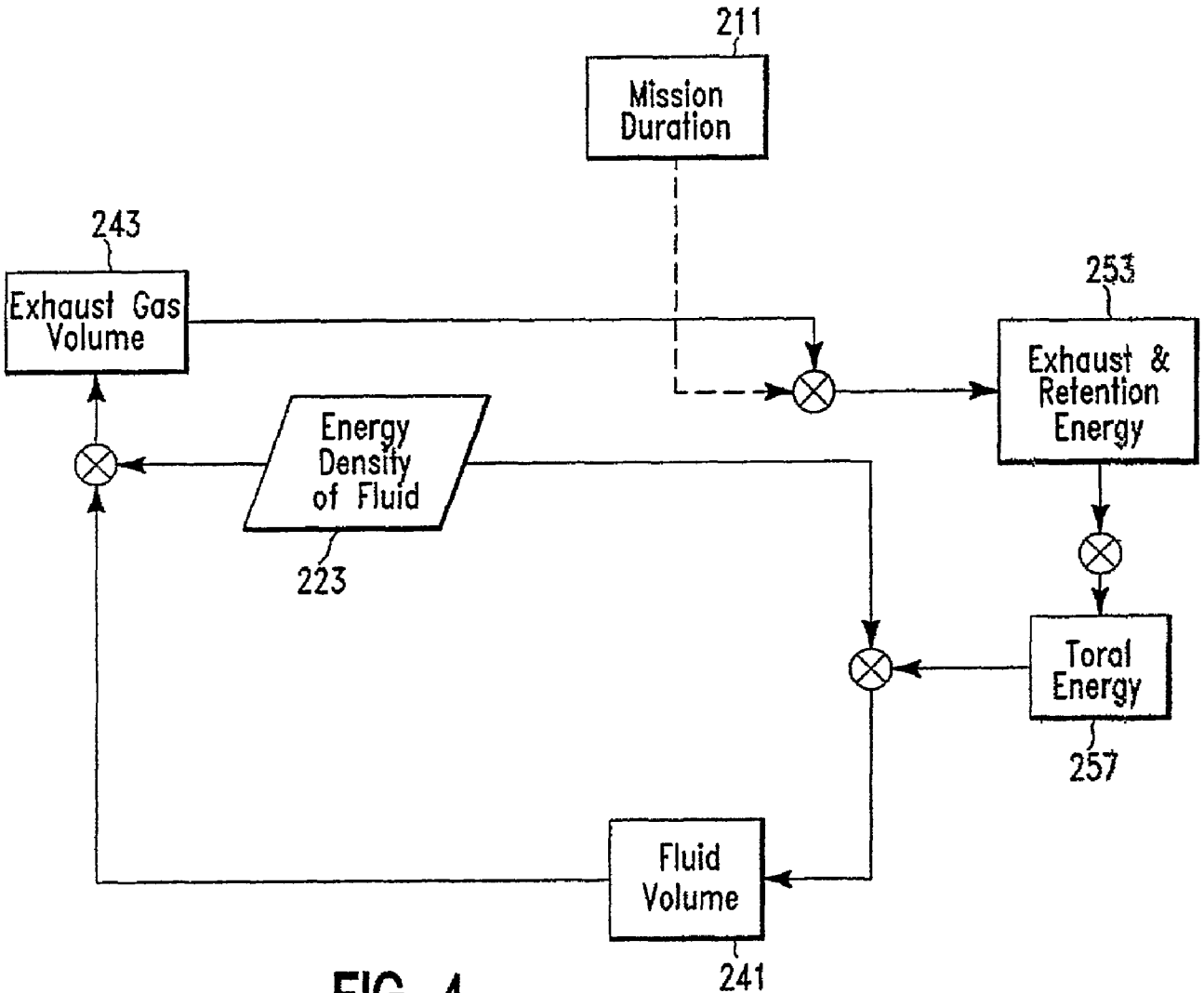
FIG. 4 is a schematic block diagram of a feedback loop of the simulation system of FIG. 3.

In modeling this system, it was noted that there was a feedback loop found which was isolated and shown in FIG. 4. As exhaust gas volume 243 becomes larger, it increases exhaust energy. This, in turn, increases the retention energy required to hold the umbilical in the access hole 5. These two energies are calculated by Exhaust and Retention unit 253. This increased energy increases the total energy calculated by total energy unit 257.

Since the total energy required has increased, the total fluid volume required will increase in unit 241. This, in turn increases the exhaust gas volume 243.

Unchecked, this system will constantly increase to infinite total system energy and infinite fluid volume required. Adjustments to the mission duration in unit 211 and energy density of the fluid in unit 223 act as controls to slow or keep the system from becoming unstable.

Figure 5A:
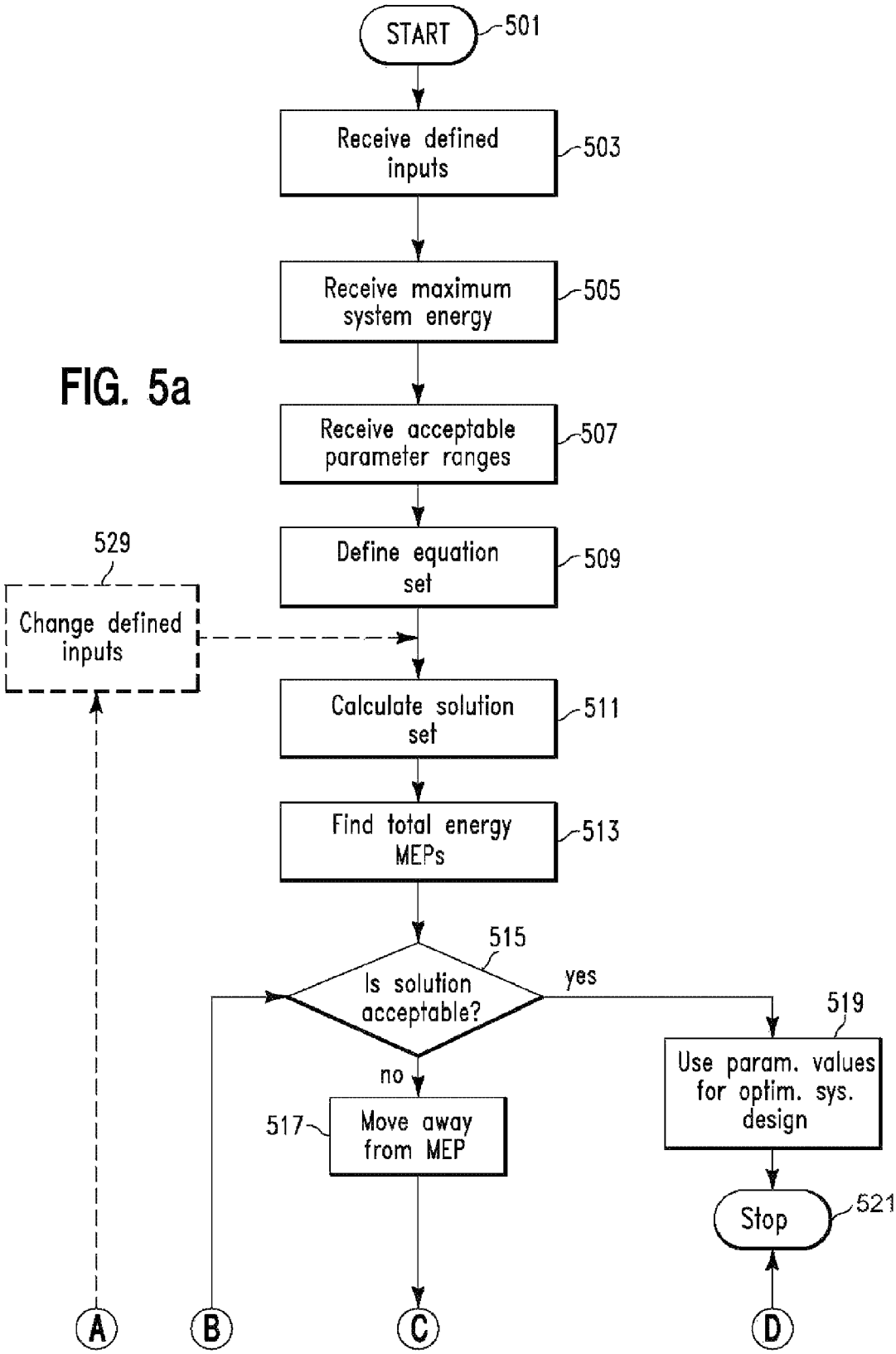
FIGS. 5*a* and 5*b* together represent a flowchart illustrating functioning of one embodiment of the present invention.
Figure 5B:
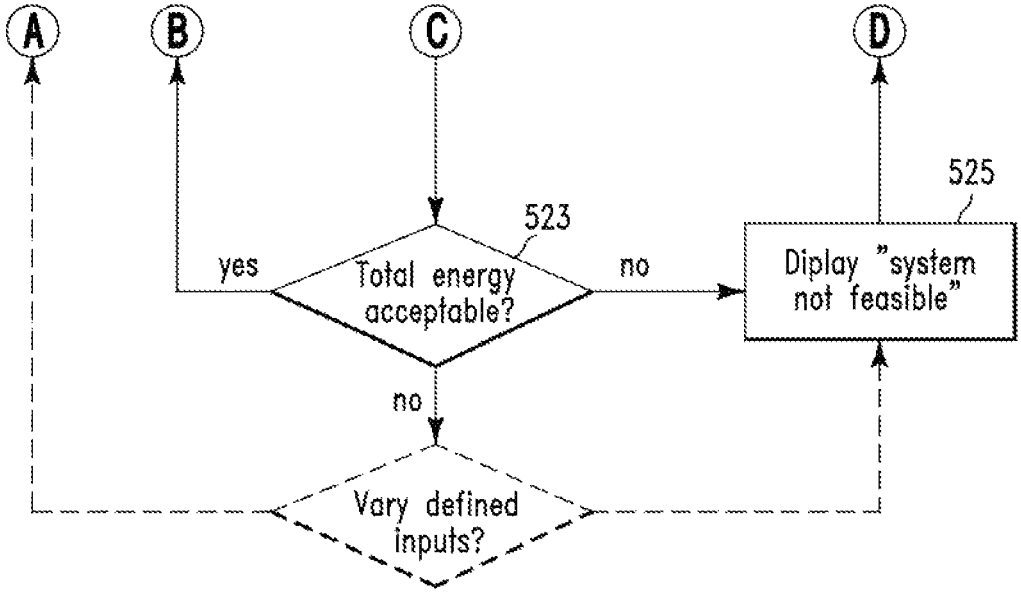
Figure 5:
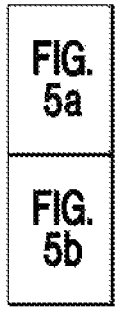

FIGS. 5*a* and 5*b* together represent a flowchart illustrating functioning of one embodiment of the present invention.

Process starts at step 501. In step 503, defined inputs are provided to the system.

In step 505, a maximum acceptable system energy is provided to the system.

Acceptable parameter vale ranges defined by the project requirements are provided to the system in step 507.

In step 509 parametric equations of the energies of the system are developed. As described above, these equations are interdependent.

In step 511, the values of at least one parameter are varied over a range and the equation sets are solved to determine total system energy. Each set of parameter values and the corresponding energy are stored as an entry in the solution set.

In step 513 the solution set is analyzed define the minimum energy points (MEPs).

In step 515 the parameter values of an MEP are initially used as the current parameter values being tested. The current parameter values are tested against the acceptable ranges. If so ("yes"), the current parameter values are used in the design of the boring system in step 519, and processing stops in step 521.

If the current parameter values do not fall within the acceptable ranges ("no"), then new current parameter values are selected in step 517, moving away from those of the MEPs.

Processing that continues in step 523 of FIG. 5*b*. In this step it is determined if the total energy of the current parameter values being tested are at or below the maximum acceptable system energy. If so ("yes"), processing continues that step 515 of FIG. 5*a*.

If the total energy of the of the current parameter values being tested is above the maximum acceptable system energy ("no") then a message is provided in step 525 indicating that the system is not feasible with the set of parameter values used, and processing stops at step 521 of FIG. 5*a*.

In an alternative embodiment of the present invention as shown in phantom, it is determined which inputs may be varied to search for a solution. For example, the energy density of the fluid or the mission duration, which were initially determined to be fixed, may now be varied in step 529. Processing then continues with the modified inputs at step 511.

Even though the above description focused on providing values for certain input parameters and solving for other parameters for illustration purposes, it is within the scope of this invention to provide different input and to solve for other parameters. Since this is a multi-variable interactive system, any may be changed to cause the remainder of the system to change accordingly.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A system [200] for modeling the energy of an energetic fluid pulsejet boring system comprising:

a. a plurality of interconnected computing devices;

b. a fluid flow energy computing unit [251] for receiving an indication of fluid volume and mission duration and for calculating fluid flow energy from its inputs;

c. an exhaust and retention energy ("EARE") computing unit [253] for receiving an indication of exhaust gas volume and mission duration as inputs and for calculating exhaust and retention energy from its inputs, d. a comminuting energy computing unit [255] for receiving an indication of hole diameter and specific energy of rock intended to be bored as inputs, and calculating comminuting energy from its inputs, e. a total energy computing unit [257] for receiving the fluid flow energy from the fluid flow energy unit [251], the exhaust and retention energy from the EARE unit, [253], and the comminuting energy from the comminuting energy unit [255], to calculate an estimate of total energy of said energetic boring system.

2. The system for modeling energy [200] of claim 1, further comprising:

a search unit [273] adapted to adjust at least one input parameter to the system for modeling energy [200] and further adapted to receive the calculated total energy from total energy unit [257] and to store the calculated total energy resulting from adjustment of the at least one input parameter along with the corresponding input parameters as entries in a solution set.

3. The system for modeling energy [200] of claim 2, further comprising:

a graphics unit [271] coupled to the search unit [273] for receiving and displaying the solution set to a user, such that the user may select solution set entries which meet pre-determined energy criteria.

4. The system for modeling energy [200] of claim 2, wherein the search unit [273] is further adapted to select at least one entry in the solution set which meets pre-determined energy criteria and identify at least one input parameter value corresponding to the selected entry.

5. A method of optimizing parameters of an energetic pulsejet boring system constrained by project requirements and a maximum total energy restriction, comprising the steps of:

a) receiving defined system inputs [503];

b) receiving a maximum allowable energy, "$E_{max}$" [505];

c) receiving said project requirements defining acceptable ranges of a plurality of system parameters [507];

d) determining an integrated set of parametric equations modeling the total energy of the system in terms of said system parameters;

e) using a computing device, calculating a solution set of entries each having system parameter values for each total energy value of the system, over a plurality of system parameter values, using the defined system inputs;

f) locating minimum energy points ("MEP") [513] in the solution set;

g) if the values of parameters at an MEP are not within the acceptable ranges [515], then selecting the parameters values to move away [517] from the MEPs until parameters are encountered which meet said project requirements;

h) if no entries are encountered before the energy of the system reaches $E_{max}$ [523], then indicating that there is no acceptable design solution based upon the given inputs [525].

6. The method of claim 5 wherein the total energy of the solution set is calculated [511] as a function of fluid flow energy, exhaust and retention energy and comminuting energy.

7. The method of claim 6 wherein the fluid flow energy of the solution set is calculated [511] as a function of fluid volume and mission duration, mission duration is a project requirement and is used as an input.

8. The method of claim 6 wherein exhaust and retention energy of the solution set is calculated [511] as a function of mission duration, which is a project requirement and is used as an input, and exhaust gas volume.

9. The method of claim 6 wherein comminuting energy of the solution set is calculated [511] as a function of hole depth, hole diameter and the specific energy of rock, where hole depth, hole diameter are project requirements and are used as inputs.

10. The method of claim 7 wherein fluid volume of the solution set is calculated [511] as a function of total energy and energy density of fluid, energy density being defined for a fluid selected and used as an input.

11. The method of claim 8 wherein exhaust gas volume of the solution set is calculated [511] as a function of fluid volume and energy density of fluid, energy density being defined for a fluid selected and is used as input.

12. The method of claim 9 wherein the specific energy of rock of the solution set is calculated [511] using a rock particle size.

13. The method of claim 12 wherein the rock particle size is determined by the drilling methodology selected.

14. The method of claim 5 further comprising the step of:

adjusting an energy density of the fluid [529] and recalculating the total system energy if no parameters are encountered before the total system energy exceeds $E_{max}$.

15. The method of claim 5 further comprising the step of:

adjusting a mission duration [529] and recalculating the total system energy if no parameters are encountered before the total system energy exceeds $E_{max}$.

16. A method of determining the system parameters values of a pulsejet boring system having a defined mission duration, hole depth, hole diameter, rock density, fluid energy density, fluid density, for a particular drilling methodology creating a specific particle size, comprising:

a. receiving an acceptable ranges [507] of hole size, penetration rates, and total energy of the system;

b. creating a integrated set of parametric equations [509] in which:

i. comminuting energy is a function of hole depth, hole diameter and specific energy of rock;

ii. exhaust & retention energy is a function of exhaust gas volume and mission duration;

iii. fluid flow energy is a function of fluid volume and mission duration, iv. total energy as the sum of comminuting energy, exhaust and retention energy, and fluid flow energy;

c. using a computing device, calculating total energy entries [513] for various hole sizes and penetration rates as a solution set;

d. determining [515] if the solution set has entries with a hole size, penetration rate and total energy within the acceptable ranges received in step "a" above; and e. using parameter values of the solution set entries within the acceptable ranges as the system parameter values for optimizing the system.

* * * * *